United States Patent [19]

Kindig et al.

[11] 3,938,966

[45] Feb. 17, 1976

[54] PROCESS FOR IMPROVING COAL

[75] Inventors: James K. Kindig, Arvada; Ronald L Turner, Lakewood, both of Colo.

[73] Assignee: Hazen Research, Inc., Golden, Colo.

[22] Filed: Mar. 25, 1974

[21] Appl. No.: 454,253

[52] U.S. Cl. ..... 44/1 R; 44/1 C

[51] Int. Cl.[2] ..... C10L 9/02

[58] Field of Search ..... 44/1 R, 1 C, 4–6; 201/17; 208/8; 75/2

[56] References Cited

UNITED STATES PATENTS

| | | | |
|---|---|---|---|
| 3,348,932 | 10/1967 | Kukin | 44/4 |
| 3,595,965 | 7/1971 | Franz et al. | 201/17 X |
| 3,736,233 | 5/1973 | Sass et al. | 201/17 |

*Primary Examiner*—Carl F. Dees

*Attorney, Agent, or Firm*—Sheridan, Ross & Fields

[57] ABSTRACT

A process for improving coal wherein the raw coal is reacted with substantially undecomposed iron carbonyl which alters the apparent magnetic susceptibility of certain impurity components contained in the raw coal thereby permitting their removal by low intensity magnetic separators. The process is especially effective for removing pyrite from coal, while at the same time reducing ash and increasing the calorific value.

9 Claims, 4 Drawing Figures

PROCESS FOR IMPROVING COAL

BACKGROUND OF THE INVENTION

With the present world-wide emphasis on the energy crisis and the rapidly diminishing sources of oil, increased attention by both government and private organizations is being given to coal as a source of energy, especially for the generation of electricity. For the year 1972 the annual consumption of coal in the United States for the generation of electricity exceeded 348 million tons. This country has vast resources of coal for development as other sources of energy diminish.

Depending upon their origin, coals contain varying amounts of iron disulfide (iron disulfide is hereinafter referred to as pyrite whether crystallized as pyrite or marcasite) from which sulfur dioxide is formed as a combustion product when coal is burned. This is a tremendous disadvantage to the use of coal as an enerby source, particularly in view of the present emphasis on pollution control as illustrated by present federal emission control standards for sulfur dioxide. Illustrating the enormity of the sulfur dioxide emission problem is the fact that large transportation expenses are incurred by coal users in transporting Western and European coal of relatively low sulfur content long distances to supplant available high sulfur-containing coals in order to make compliance with sulfur dioxide emission standards possible when using coal as an energy source. At this time there are no effective means available which are commercially feasible for absorbing the large amounts of sulfur dioxide emitted by the combustion of coal to produce heat and electricity. Currently U.S. utilities in burning about 395 million tons of coal a year generate about 21 million tons of sulfur dioxide in the process. One solution to the problem is to separate the sulfur-bearing pyrite from the coal before it is burned.

Coals also contain, depending upon their origin, various amounts and kinds of minerals which form ash when the coal is burned. The ash also is a disadvantage to the use of coal as an energy source, since it contributes no energy value during combustion thereby diluting the calorific value of the coal, causes a waste disposal problem, and a potential air pollution problem.

The problem of separating pyrite or other impurities from raw coal is not new and a number of methods have been extensively tested over the years. Among these are methods which employ the difference in specific gravity between coal particles and the impurity particles or differences in their surface, electrostatic, chemical or magnetic properties. For one reason or another difficulties are encountered in making an efficient separation of pyrite or other impurities from coal which has been ground finely enough to substantially liberate impurity particles from coal particles. In water systems this difficulty is related to the slow settling rate of fine particles and in air systems to the large difference in specific gravity between air and the particles. However, for magnetic separations the magnetic attraction force acting on small magnetic particles is many times greater than the opposing separating force, which is usually a hydraulic drag and/or gravity force.

For the separation of pyrite or other impurities from raw coal the success of a magnetic process is dependent on some effective pre-treatment process for selectively enhancing the magnetic susceptibility of the pyrite or impurity particles. Coal particles alone are slightly diamagnetic while pyrite and many other mineral impurities are weakly paramagnetic; however, their paramagnetism is not sufficient to economically effect a separation from coal. However, effective beneficiation of coals can be made if the apparent magnetic susceptibility of pyrite or other impurities is increased. For pyrite it has been estimated that a sufficient increase in susceptibility can be achieved by converting less than 0.1 percent of pyrite in pyritic coal into ferromagnetic compounds of iron. ("Magnetic Separation of Pyrite from Coals," Bureau of Mines Report of Investigations 7181, P.1.)

In discussing the use of heat to enhance the paramagnetism of pyrite it is stated in the above report (P.1) that ferromagnetic compounds of iron are not formed in significant quantities at temperatures below 400°C, and that such conversion occurs in sufficient quantities to effect beneficiation only at temperatures greater than 500°C. As this is above the combustion point of coal, the use of heat to enhance magnetic susceptibility does not appear feasible. Further, other methods for enhancing the paramagnetism of pyrite to permit its separation from coal have not been encouraging.

Accordingly, it is a principal object of this invention to provide an economically feasible method for improving raw coal by enhancing the apparent magnetic susceptibility of pyrite or other impurities associated with but substantially liberated from the raw coal to the point where these impurities can be successfully separated from the coal by magnetic separators.

It has been found that pyrite reacts with iron carbonyls to form one or more compounds different from pyrite and having a magnetic susceptibility very much greater than the original pyrite. Although iron pentacarbonyl has proven effective in the reaction, it is obvious that other carbonyls, such as iron nonacarbonyl or a mixture of iron carbonyls would also be effective and the term "iron carbonyl" as used herein includes all carbonyls of iron and mixtures thereof. This discovery can be used to alter the surface of the pyrite by applying the carbonyl treatment so that the apparent magnetic susceptibility of the pyrite is increased. Pyrite particles that have been so treated can then be separated by magnetic processing from other materials which are inert to a surface treatment of iron carbonyl. Such a process has wide application in the field of mineral beneficiation.

SUMMARY OF THE INVENTION

The apparent magnetic susceptibility of pyrite as well as other associated impurities in coal is increased to the point where selective magnetic separation of these impurities from the coal particles is feasible. The increase is effected by contacting coal containing pyrite or other impurities liberated from the coal with an iron carbonyl like iron pentacarbonyl under conditions at which ordinary pyrolytic decomposition of the iron carbonyl into metallic iron and carbon monoxide is not appreciable. With pyrite a chemical reaction between the iron carbonyl and the pyrite particles occurs to form a replacement shell, on the surface of the pyrite particles, of a material having a magnetic susceptibility significantly greater than that of untreated pyrite. The carbonyl treated coal product is then passed through a magnetic separator for removal of the pyrite and impurity particles.

It is desirable to have the coal comminuted finely enough to give substantial liberation of impurities from coal particles. The carbonyl is introduced as a vapor into a reaction chamber containing the coal. These carbonyl vapors can be carried into the chamber by a gas, inert to the reaction, by first passing the gas over or through a vessel holding liquid iron carbonyl.

BRIEF DESCRIPTION OF THE DRAWINGS

The operation of the invention will be explained in conjunction with the accompanying drawing showing reproductions of photomicrographs of products obtained in comparative tests using and not using the process of the invention, the figures of the drawing being described as follows.

DESCRIPTION OF THE PREFERRED EMBODIMENTS

Figure 1:
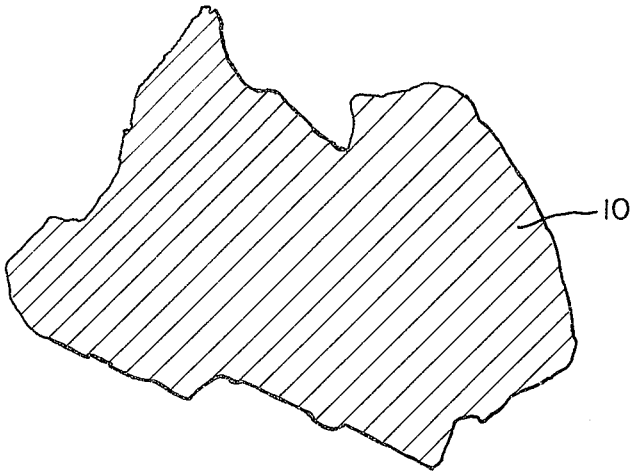
FIG. 1 is a copy of a photomicrograph of an untreated particle of native Colorado pyrite not associated with coal measures.

The invention is especially useful for reducing the content of pyrite from coals containing these impurities. The invention can be applied to coals of diverse origins and rank including coking, steam, and other coals as well as refuse from coal cleaning plants, and the term "coal" as used herein includes all of these types of coal. Depending on adequate coal-pyrite liberation, pyrite removal approaching the theoretical limit is possible.

The probable typical reaction which generates the ferromagnetic species comprising the outer shell of treated pyrite particles that enhances the apparent magentic susceptibility of the pyrite particles is as follows:

| | | | | |
|---|---|---|---|---|
| $FeS_2$ + | $X\ Fe(CO)_5$ | $Fe_{(1+x)}S_2$ | + | $5X\ CO$ |
| iron disulfide (pyrite or marcasite) | iron carbonyl | "iron-rich disulfide" | | carbon monoxide |

The "iron-rich disulfide" forms as a replacement shell around the pyrite grains and is highly magnetic.

For efficient separations of pyrite from coal, the coal should be crushed to such fineness that pyrite particles are free, or nearly free, from the coal particles. The required fineness depends upon the size distribution of the pyrite in the coal. A thorough treatment of the subject for power plant coals is given in the article entitled "Pyrite Size Distribution and Coal-Pyrite Particle Association in Steam Coals," Bureau of Mines Report of Investigation 7231. The requirement for pyrite liberation applies to all types of physical separations and so is not a disadvantage to this invention. Additionally, present technology for coal-fired power plants generally requires pulverizing the coal to 60–90 percent minus 200 mesh before burning.

The process is applied by contacting the raw coal which is liberated from pyrite or other impurities with iron carbonyl under conditions where there is an insufficient dissociation of carbonyl into metal and carbon monoxide to cause substantial deposition of metal on the coal particles. These conditions are determined by the temperature, the type of carbonyl, pressure, gas composition, etc. Ordinarily, the carbonyl gas is heated to a temperature just below its decomposition temperature under the reaction conditions. Various types of available equipment cana be used for contacting the iron carbonyl and coal, such as, a rotating kiln used as the reaction vessel with iron carbonyl vapors carried into contact with the tumbling contents of the kiln by a gas such as nitrogen which is inert to the reaction process.

The process must be carried out at a temperature below the temperature of major decomposition of the carbonyl under the reaction conditions so that there is opportunity for the iron of the carbonyl to chemically react with the pyrite particles. Obviously, if the temperature is allowed to rise above the decomposition temperature of the carbonyl for a sufficient time, the coal will be coated with iron and the pyrite particles will either react with or be coated with metallic iron to give both types of particles high magnetic susceptibilities, thus preventing their separation magnetically.

The amount of carbonyl used and the time of treatment can be varied to affect the percent of pyrite reacted. The carbonyl must be in contact with the pyrite particles a sufficient time for the outer shell of reacted material to form on the particles. The thickness of this outer shell determines the extent to which the apparent magnetic susceptibility is increased; judgment of optimum thickness is a balance between reaction rate of shell formation and economics of the reaction process and magnetic separation process. Generally a reaction time not in excess of about two hours is adequate. Analyses of the residual sulfur in a portion of treated coal after magnetic separation of the pyrite will indicate optimum treating time, amount of carbonyl used, and other reaction parameters necessary for obtaining coal containing permissible amounts of sulfur.

The invention is illustrated by the examples presented below in which iron pentacarbonyl was reacted with iron disulfides of various origins either alone or mixed with coal.

The examples are illustrative of the invention but not limiting thereof.

EXAMPLE 1

Initial experiments were made with an igneous pyrite concentrate from Colorado in order to be dealing with essentially a pure pyrite rather than a material containing mostly coal and only a little pyrite. This Colorado pyrite was tested and found to be non-magnetic. A sample of this Colorado pyrite was placed in a rotating kiln. Iron carbonyl vapors, carried in argon, were passed over the pyrite which was heated to a temperature of 195°C which is below the temperature where metallic iron forms in abundance under the conditions of the test. The treatment time was one hour, although treatment times and temperatures will vary as explained above. The product from this run was highly magnetic.

A polished section of the reacted material showed a replacement shell of the newly formed compound around the pyrite grain. No such shell was formed around gangue particles. From a microscopic study of the section, it was obvious that the replacement shell was not metallic iron but rather a reaction product of different color which has replaced the pyrite.

Figure 2:
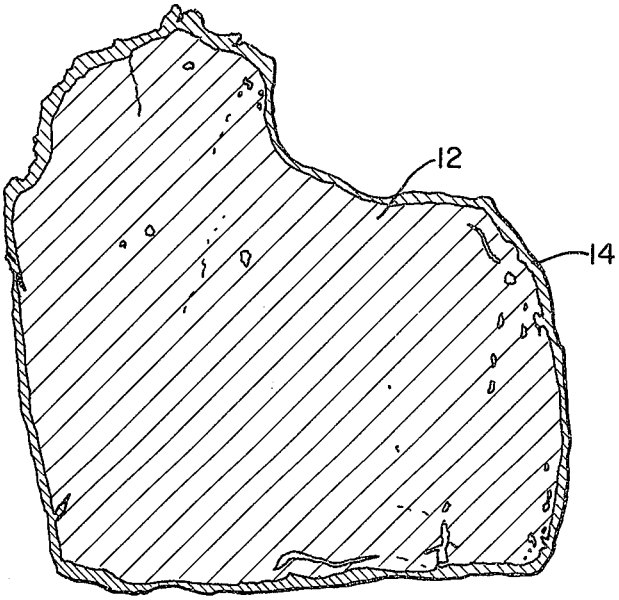
FIG. 2 is a copy of a photomicrograph of a particle of the same type pyrite altered by the carbonyl treatment process of the invention.

Referring to FIG. 1 of the drawing, wherein the numeral 10 indicates a depiction of a photomicrograph of a sectioned particle of untreated Colorado pyrite, it will be seen that the particle is of the same material throughout and there is no layer on the periphery of the particle. The particle showed no attraction to a low intensity magnet. In contrast, inspection of FIG. 2, the same type illustration of a particle of the same material sectioned after treatment by the process of the invention, shows an outer replacement shell 14 around the periphery of the particle of a material of an entirely different composition than that of the pyrite particle. This replacement shell had an entirely different color and luster than that of the pyrite particle. There was a definite line of demarcation between the shell and the particle. The treated particle shown in FIG. 2 was attracted to a low intensity magnet.

Figure 3:
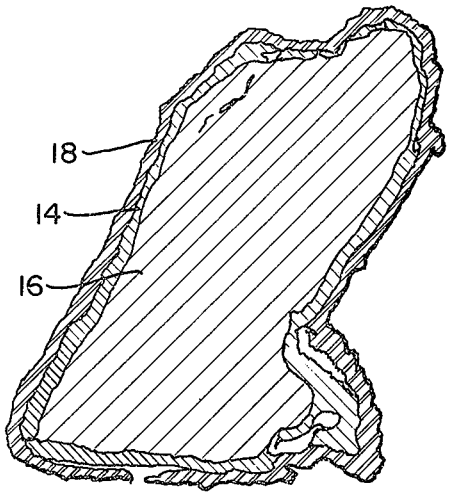
FIG. 3 is a copy of a photomicrograph of a particle of the same type pyrite in which the particle was first given the carbonyl treatment of the process of the invention to form an altered particle like that of FIG. 2 followed by further treatment not a part of the process in which iron pentacarbonyl was thermally decomposed to form the outer layer of iron.

FIG. 3, the same type illustration as that of the other figures, shows a particle 16 of the same type pyrite as the particles of the first two figures. The particle 16 was first treated in accordance with the process of the invention with undecomposed iron pentacarbonyl vapors at a temperature of 190°C to form the outer replacement shell 14 of the same composition as the shell 14 of FIG. 2. The particle 16 with the replacement shell 14 on it was then further treated with the carbonyl at temperatures up to 225°C to effect decomposition of the carbonyl with the result that an outer shell or layer 18 was deposited over the shell 14 and this outermost layer 18 was readily recognizable as iron. The cleavage between layers 14 and 18 was very distinct and outer layer 18, of course, had a different color, luster, and texture than layer 14. This illustrates what would happen if the reaction conditions are such during the practice of the process of the invention that the carbonyl decomposes, i.e., the coal particles would become coated with iron and selective magnetic separation of the pyrite particles would not be possible.

EXAMPLE 2

The process was applied to an Iowa coal containing 7.8% pyrite sulfur, thus providing an example of a pyrite that was of sedimentary origin and deposited in a coal matrix. The raw coal for this test was charged into a kiln which was then rotated. To introduce the iron pentacarbonyl into the reaction zone, an inert gas was passed through liquid iron pentacarbonyl at room temperature contained in a vessel outside the kiln with the gas carrying carbonyl vapors then being introduced into the reaction zone of the kiln. The reaction zone was held between 185°C and 195°C for one hour, following which the kiln was purged of carbonyl vapors by the insert gas and the reaction zone cooled to room temperature.

Figure 4:
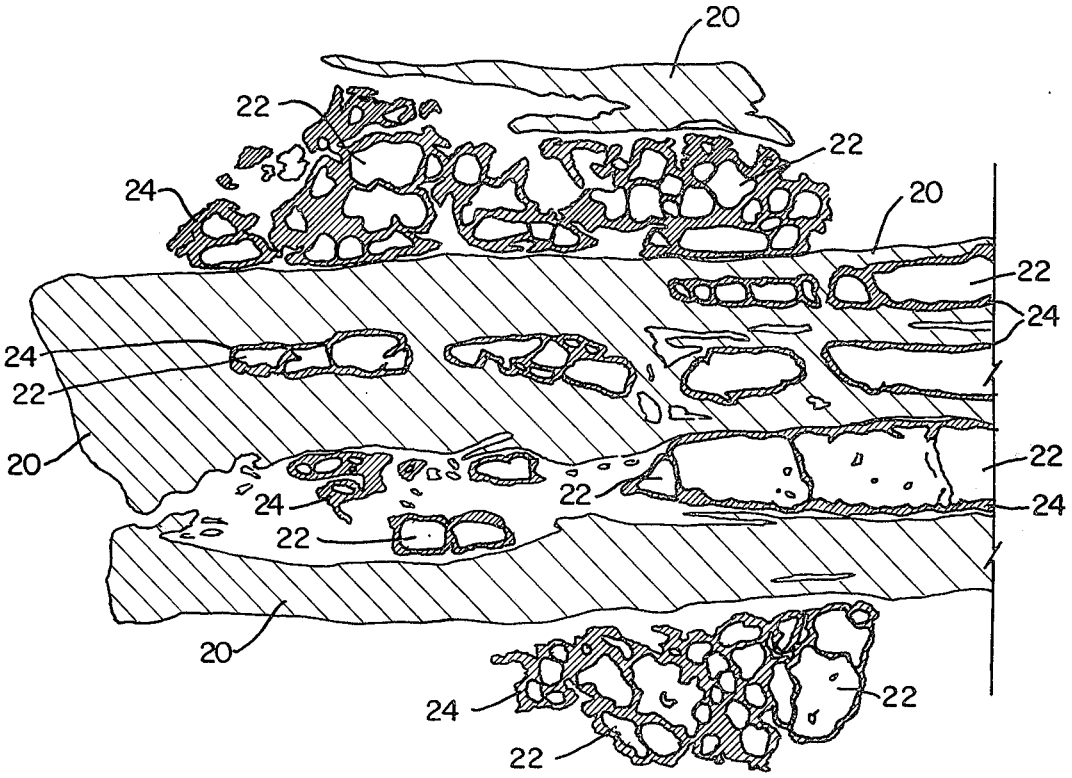
FIG. 4 is a copy of a photomicrograph of a particle from an Iowa coal seam showing a locked coal and pyrite particle which has received the carbonyl treatment of the process.

A polished section was prepared from the magnetic fraction of material obtained by processing the carbonyl treated coal with a low intensity magnet. One particle from this polished section was photographed and is depicted in FIG. 4 of the drawing. It will be seen that the particle is comprised of coal (20) locked to pyrite (22). However, as was noted in FIG. 2 there is a replacement shell (24) of different color and luster around the pyrite and this shell has even invaded the cracks and fissures in the pyrite. There is no evidence of any iron deposition either around the pyrite or around any of the coal surface.

EXAMPLE 3

The process was also applied to a bituminous coal from central Pennsylvania. The coal was charged into a kiln which was then rotated. The introduction of iron pentacarbonyl into the reaction zone was as described in Example 2. The reaction zone was held between 185°C and 195°C for one hour following which the kiln was purged of carbonyl vapors by the inert gas and the reaction zone cooled to room temperature. Three products were made by magnetic separation using magnets of different field strengths, a "magnetic fraction," "weakly magnetic fraction," and "non-magnetic fraction," with the "magnetic fraction" obtained from wet processing. Two magnets were used in the separation; a laboratory Davis tube tester and a small, hand horseshoe, Alnico magnet. These three products were analyzed for forms of sulfur, ash, and calorific value (Btu); results are given in Table 1.

TABLE 1

ANALYSES OF PRODUCTS BOTH TREATED AND UNTREATED BY THE INVENTION
Coal Description: Lower Freeport Bituminous Coal from Pennsylvania.
Size treated 14×200 Mesh, not all pyrite liberated at this size.

| | Weight (%) | Ash (%) | Calorific Value (Btu) | Sulfur Total (%S) | Sulfur Inorganic[1] (%S) | Sulfur Organic (%S) |
|---|---|---|---|---|---|---|
| **Material Untreated by the Process** | | | | | | |
| Raw Coal[2] | 100.0 | 22.1 | 12,106 | 1.99 | 1.71 | 0.28 |
| **Material Treated by the Process** | | | | | | |
| Clean Coal (non-magnetic fraction) | 79.2 | 13.2 | 13,556 | 1.10 | 0.69 | 0.41 |
| Middling (weakly magnetic fraction) | 14.1 | 53.2 | 6.467 | 4.40 | 4.22 | 0.18 |
| Refuse (magnetic fraction) | 6.7 | 51.6 | 6,828 | 8.22 | 8.05 | 0.18 |

[1]Inorganic sulfur is mostly pyritic sulfur plus a small amount of sulfur from the pyrite altered by the carbonyl treatment and any sulfate prese 0.01% for this coal.
[2]Not responsive to low intensity magnets.

As can be seen from Table 1, magnetic separation of coal that did not receive the carbonyl treatment results in no magnetic material and, therefore, no beneficiation by magnetic processing. However, with treatment and magnetic processing, two or more products may be obtained depending on the operating conditions of the magnetic separators. Results of a three-product separation are shown in Table 1. The process removed almost 70% of the pyritic sulfur. Not all pyritic sulfur was liberated at the size treated in this example so the 68% reduction may in fact represent all the liberated pyrite.

The process also reduced the ash from 22.1 to 13.2 percent. This is a marked reduction in ash in the clean coal product, and it is a greater reduction than can be attributed to the reduction in ash that occurs because pyrite, an ash-forming mineral, was removed from the clean coal. It is not known at this time if the ash-forming minerals are attracted to the magnet because they are locked with pyrite particles or if their apparent magnetic susceptibility is increased by the carbonyl treatment. In any event, there is a significant lowering of ash in the clean coal product. The table also reflects the concomitant improvement in the coal by the increase in the Btu value of the clean coal resulting from ash and sulfur reductions. Similar improvements would be observed with other tests which characterize the coal, for example, volatile matter, grindability, etc.

From the above, it will be seen that a process has been disclosed for improving coal by increasing the apparent magnetic susceptibility of pyrite and other impurities in the raw coal to a point that permits an economically feasible separation of a large percentage of these impurities from the coal by magnetic separation processes.

What is claimed is:

1. A process for beneficiating coal, including reducing sulfur and ash, increasing calorific value, and improving other properties, which comprises contacting a coal which contains impurities, such as pyrite or marcasite or other ash-forming minerals, which are substantially liberated from the coal particles, with an iron carbonyl under reaction conditions which substantially preclude the general thermal dissociation of the carbonyl into iron and carbon monoxide, in order to increase the apparent magnetic susceptibility of the impurities so that a magnetic separation between the coal and impurities may be effected.

2. The process of claim 1 in which the treated coal is subjected to a magnetic field to remove the impurities.

3. The process of claim 2 in which the iron carbonyl is iron pentacarbonyl.

4. The process of claim 2 in which the carbonyl is in gaseous form and is contacted with the coal in an inert carrier gas.

5. A process for beneficiating coal associated with impurities, such as, pyrite and ash-producing impurities, which comprises the steps of:

a. reducing the coal and associated impurities to a fine particle size to liberate substantially all of the impurities from the coal;

b. placing the mixture of coal and liberated impurities in a gas treatment chamber;

c. contacting an inert carrier gas with iron carbonyl vapor to incorporate the iron carbonyl vapor in the carrier gas;

d. introducing the iron carbonyl vapor in the carrier gas into said chamber under conditions which preclude substantial decomposition of the iron carbonyl, and e. maintaining the iron carbonyl vapor in contact with said mixture for a sufficient time for the undecomposed iron carbonyl to react with the pyrite particles.

6. The process of claim 5 in which the temperature in the chamber is not in excess of about 250°C.

7. A process for beneficiating coal, including reducing sulfur and ash, increasing calorific value, and improving other properties, which comprises contacting a coal which contains impurities, such as pyrite or marcasite or other ash-forming minerals, which are substantially liberated from the coal particles, with an iron carbonyl in order to increase the apparent magnetic susceptibility of the impurities so that a magnetic separation between the coal and impurities may be effected.

8. The process of claim 7 performed under conditions to preclude coating of the coal particles with iron from the carbonyl to make them magnetic.

9. The process of claim 7 in which the treated coal is subjected to a magnetic field to remove the impurities.

* * * * *